US005402089A

United States Patent [19]

Tsuda et al.

[11] Patent Number: 5,402,089

[45] Date of Patent: Mar. 28, 1995

[54] ASYMMETRICALLY COUPLED $TE_{21}$ COUPLER

[75] Inventors: George I. Tsuda; Harold A. Uyeda, both of Fullerton, Calif.

[73] Assignee: Highes Aircraft Company, Los Angeles, Calif.

[21] Appl. No.: 151,084

[22] Filed: Nov. 12, 1993

[51] Int. Cl.[6] ..... H01P 1/16; H01P 5/18

[52] U.S. Cl. ..... 333/113; 333/21 R

[58] Field of Search ..... 333/21 R, 113, 125, 333/137

[56] References Cited

U.S. PATENT DOCUMENTS 4,566,012 1/1986 Choung et al. ..... 333/113 X

FOREIGN PATENT DOCUMENTS 2054583 5/1972 Germany ..... 333/113

*Primary Examiner*—Paul Gensler

*Attorney, Agent, or Firm*—W. K. Denson-Low

[57] ABSTRACT

A $TE_{21}$ coupler having at least two auxiliary rectangular waveguides asymmetrically disposed around the center line of a $TE_{21}$ circular waveguide, the waveguides sharing common walls in which coupling slots are disposed, the slots providing for rectangular $TE_{10}$ mode propagation coupling to orthogonally aligned $TE_{21}$ modes in the circular waveguide.

9 Claims, 7 Drawing Sheets

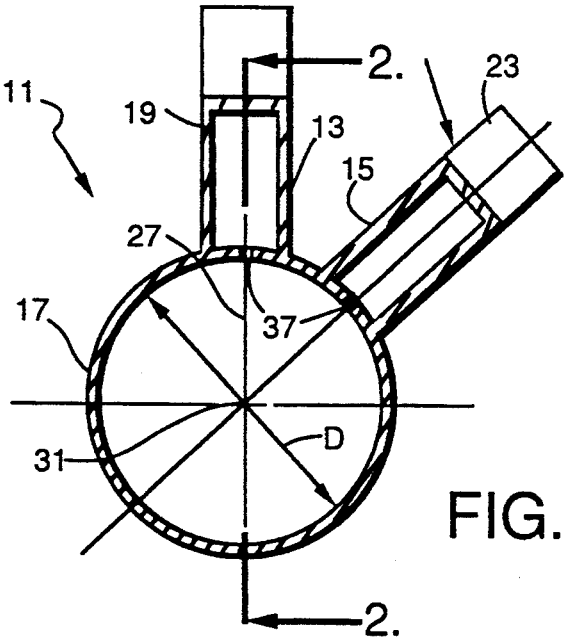
FIG. 1.
FIG. 2.
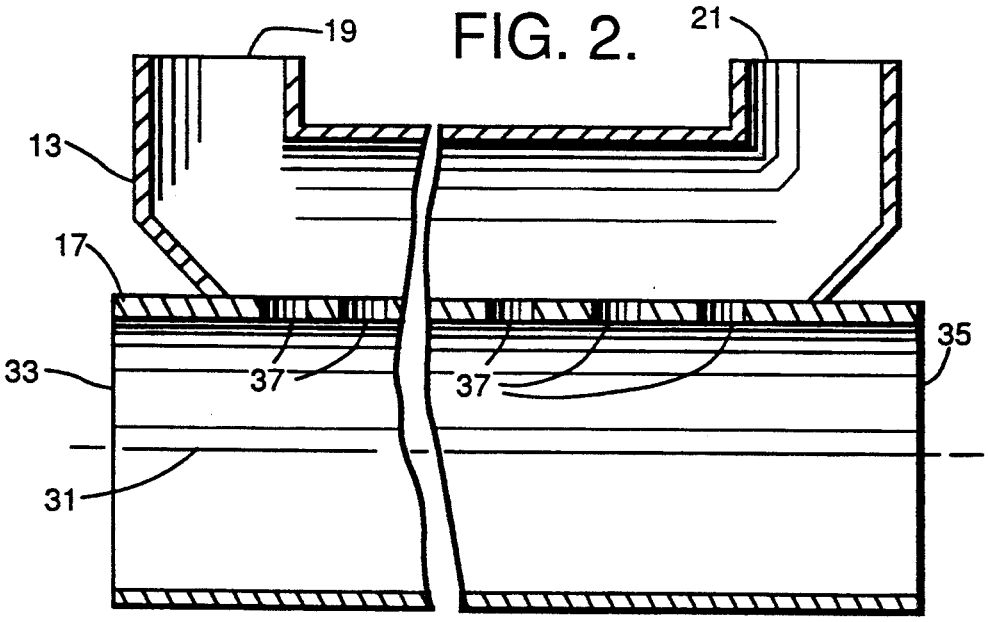
FIG. 3.
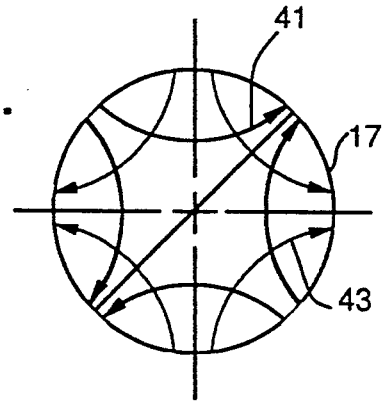

FIG. 8.
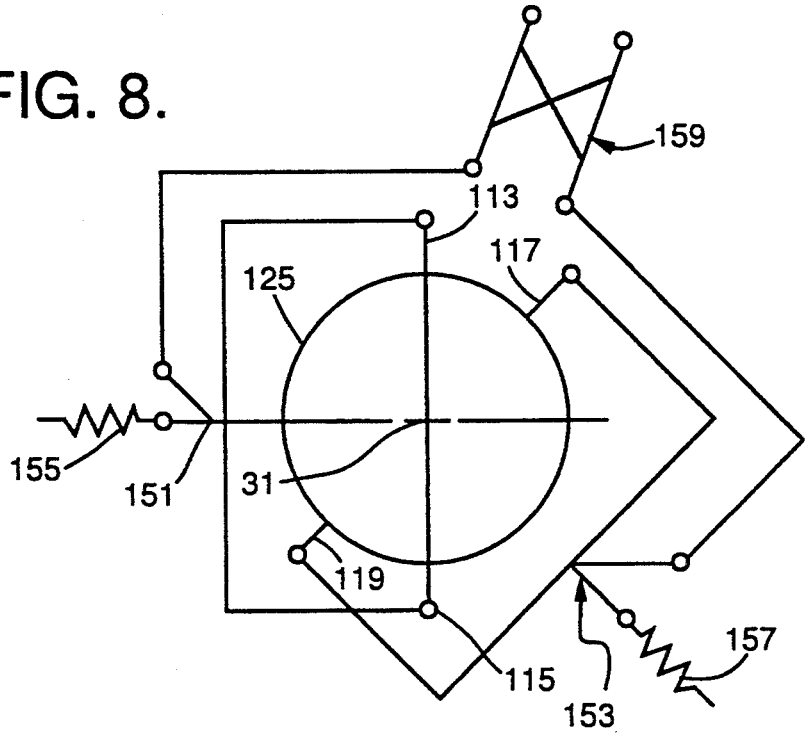
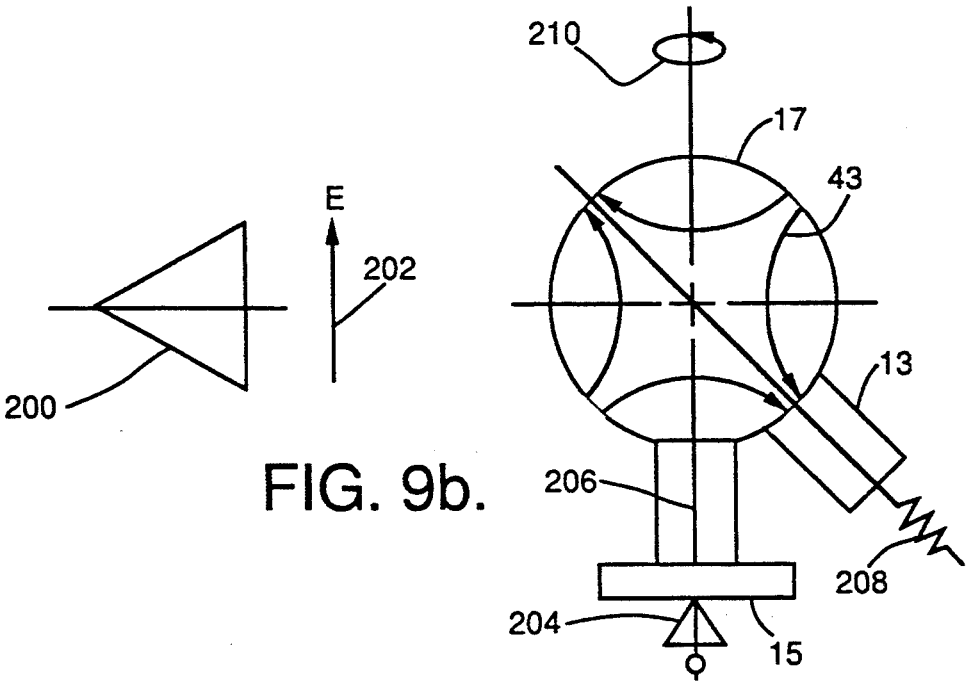
FIG. 9b.

ASYMMETRICALLY COUPLED $TE_{21}$ COUPLER

BACKGROUND

The present invention relates to microwave waveguide coupling devices, and more particularly to $TE_{21}$ circular waveguide couplers.

Prior art $TE_{21}$ coupler designs employ four auxiliary rectangular waveguide lines symmetrically oriented around the main line circular waveguide to excite or receive a $TE_{21}$ mode. These lines are subsequently connected to a 1:4 power distribution network. To convert this coupler to a circularly polarized $TE_{21}$ mode, two sets of four auxiliary lines and two sets of 1:4 power distribution networks are required.

In other words, current $TE_{21}$ circular waveguide couplers employ eight auxiliary rectangular waveguides to receive a circularly polarized $TE_{21}$ circular waveguide mode, and two sets of 1:4 power combining circuitries and a quadrature hybrid are required to combine the outputs from the eight auxiliary coupler lines.

The disclosed invention, on the other hand, employs only one or two auxiliary lines for each $TE_{21}$ mode excitation in the circular waveguide. With a single auxiliary line, no distribution network is required. For a two line coupler, a 1:2 power distribution network is required. The choice of a single or dual auxiliary line coupler depends on the length of the coupler and the coupling factor of the auxiliary coupling lines. If length is not a consideration, then a single line coupler is employed. A dual line coupler is used where it is required to constrain the coupler length. The main advantage gained is the significant reduction in the complexity and construction and hence, the cost of the power divider and feed circuitry.

The modified coupler design uses only two, or at the most, four auxiliary lines to achieve the same capabilities and performance of the $TE_{21}$ circular waveguide coupler. This reduces the complexity of the combining circuitry. For a two auxiliary line coupler, only a quadrature hybrid is required. For a four auxiliary line coupler, two sets of 1:2 combiners and a quadrature hybrid are required.

SUMMARY OF THE INVENTION

Parabolic reflector and Cassegrain antennas with difference tracking capabilities can employ a $TE_{21}$ circular waveguide coupler to provide tracking difference beams. The $TE_{21}$ coupler basically consists of a main line circular waveguide capable of supporting all modes up to the $TE_{21}$ mode and rectangular waveguides as the auxiliary coupling lines. The $TE_{21}$ circular waveguide mode is coupled to the main line by exciting one or two of the auxiliary rectangular waveguide lines. To generate or receive a circularly polarized $TE_{21}$ mode in the circular waveguide, two sets of coupling lines oriented to provide orthogonal $TE_{21}$ modes are employed with a time phase differential of 90° between them.

The modified $TE_{21}$ coupler described in this disclosure impacts feed designs employed in Cassegrain reflector systems where the $TE_{21}$ circular waveguide mode provides difference tracking signals. It is used directly in line with the $TE_{11}$ feed line which produces the sum beam. The coupler is designed to be non-interactive with the $TE_{11}$ mode so that there is no impact on the propagation of the $TE_{11}$ and $TE_{21}$ modes. It has direct application to feeds for reflector type antenna systems which require efficient sum and difference illuminations.

In accordance with an embodiment of the present invention, an asymmetrically coupled $TE_{21}$ coupler is provided that includes a $TE_{21}$ circular waveguide dimensioned to support no higher order circular waveguide modes, and which waveguide has a center line therethrough. At least two auxiliary rectangular waveguides are asymmetrically disposed around the circular waveguide relative to the center line of the circular waveguide, the rectangular and circular waveguides sharing respective common walls through which coupling slots are disposed to provide rectangular $TE_{10}$ mode propagation coupling to orthogonally aligned $TE_{21}$ modes in the circular waveguide.

A quadrature hybrid may be employed to combine the two equal orthogonally aligned $TE_{21}$ modes with a 90° time phase offset. Further, four auxiliary rectangular waveguides making up two pairs of oppositely disposed auxiliary lines may be disposed asymmetrically about a $TE_{21}$ circular waveguide, where each pair of rectangular guides are coupled through appropriate coupling slots to orthogonal $TE_{21}$ circular waveguide modes.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 is a cross sectional view of dual auxiliary line $TE_{21}$ circular waveguide coupler constructed in accordance with an embodiment of the present invention;

FIG. 2 is an elongated sectional view taken along line 2—2 of FIG. 1;

FIG. 3 is a mode excitation diagram of the circular waveguide of FIG. 1;

FIG. 8 shows combining circuitry for the four auxiliary line $TE_{21}$ coupler of FIG. 5;

FIG. 9B illustrates the test setup for measuring the $TE_{21}$ H-plane pattern orthogonal to the auxiliary waveguide;

DETAILED DESCRIPTION

Figure 4:
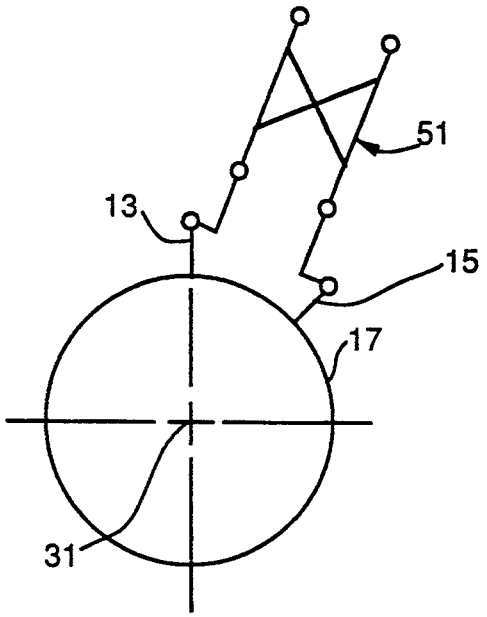
FIG. 4 illustrates combining circuitry for the two auxiliary line $TE_{21}$ coupler of FIG. 1.

Conventional tracking feeds for parabolic reflectors and Cassegrain antennas include a multihorn or single horn aperture with endfire elements added to provide the difference tracking beams. Use of higher order $TE_{21}$ or $TM_{01}$ circular waveguide modes instead of the end fire elements may also be utilized for producing difference beams. The $TE_{21}$ circular waveguide coupler, for example, is one device that produces difference beams, and it can be excited by symmetrical or asymmetrical auxiliary coupling lines.

There are two possible configurations of the asymmetrically coupled $TE_{21}$ circular waveguide coupler in accordance with the present invention. The first embodiment 11 employs two auxiliary rectangular waveguides 13 and 15 coupled to a circular waveguide 17, as illustrated in, FIGS. 1 and 2. The rectangular waveguides or lines have ports 19, 21 and 23, 25 (not shown) and lie along different radial planes 27 and 29, respectively, and the asymmetry results from the orientation of the auxiliary lines 13 and 15 which are not symmetrically disposed (about 45° shown) around the circular waveguide 17 relative to its center line 31.

The circular waveguide has a first port 33 and a second port 35, and its diameter D is selected by well known means so that the circular waveguide 17 supports the $TE_{21}$ mode but is cut off to all other higher order circular waveguide modes. The propagation constant, which is dependent on the waveguide dimensions, of each type waveguide are made equal; that is, the rectangular waveguide $TE_{10}$ mode propagation constant of the guides 13 and 15 is made equal to the $TE_{21}$ circular waveguide mode propagation constant of the circular waveguide 17.

Coupling slots 37 located between the main guide 17 and auxiliary lines 13 and 15 are equally spaced at ¼the waveguide wavelength for the $TE_{21}$ circular waveguide mode or the $TE_{10}$ rectangular waveguide mode. This spacing allows only the $TE_{21}$ circular waveguide mode to couple to the auxiliary lines and will not accept the higher order modes due to the cutoff properties of the main line 17. Since the auxiliary lines 13 and 15 are coupled to orthogonally aligned $TE_{21}$ modes 41 and 43 (FIG. 3), a conventional quadrature hybrid 51, shown schematically in FIG. 4, combines two equal signals with a 90° time phase offset, and is employed to receive a circularly polarized $TE_{21}$ mode.

Figure 5:
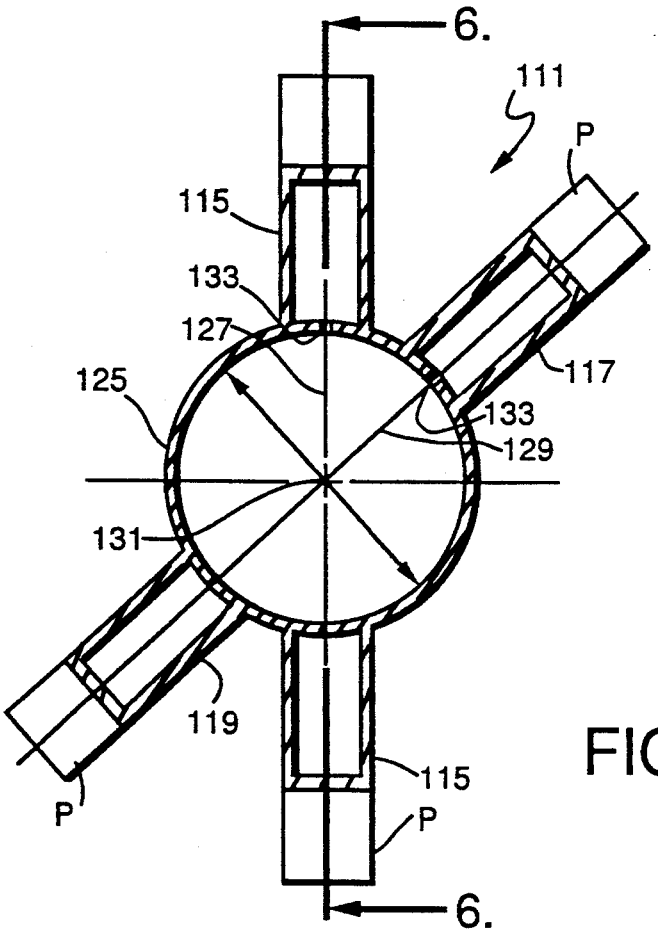
FIG. 5 is a cross sectional view of a four auxiliary line $TE_{21}$ circular waveguide coupler constructed in accordance with another embodiment of the present invention.
Figure 6:
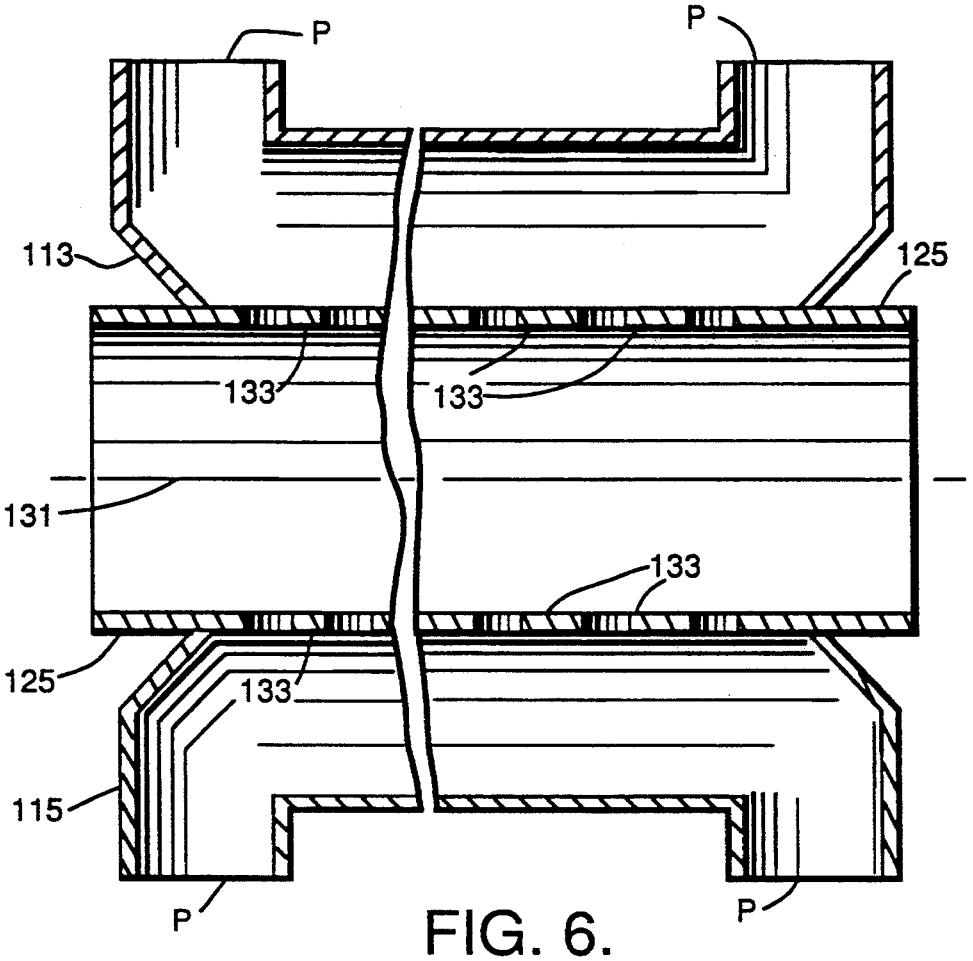
FIG. 6 is an elongated sectional view taken along line 6—6 of FIG. 5.
Figure 7:
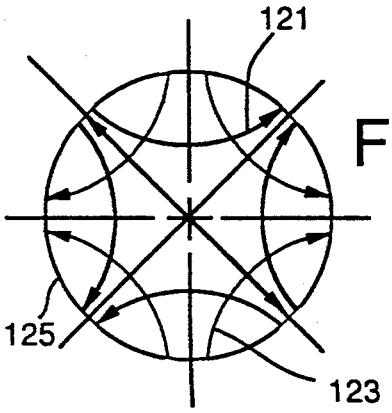
FIG. 7 is a mode excitation diagram of the waveguide of FIG. 5.

The second configuration, a four auxiliary line $TE_{21}$ circular waveguide coupler, is illustrated as embodiment 111 in FIGS. 5 and 6. It employs four auxiliary lines comprising two pairs (pair 113, 115, and pair 117, 119), with each pair coupled to orthogonal $TE_{21}$ circular waveguide modes 121 and 123, respectively, in a circular waveguide 125. This coupling of the rectangular waveguides is shown in the mode excitation diagram of FIG. 7.

Although each pair of auxiliary lines 113, 115 and 117, 119 is symmetrically disposed with respect to each other, the orientation of all four lines is not symmetrically oriented around the periphery of the circular waveguide 125. For example, guides 113 and 115 lie along a first plane 127, while guides 117 and 119 lie along a second plane 129 at approximately a 45° angle, and that intersects with the first plane and a center longitudinal axis 131 of the circular waveguide 125, best seen in FIG. 5.

The rectangular waveguides have associated ports P, and conventional coupling slots 133 are located in common walls between the rectangular lines and the main circular waveguide line 125. The design details for propagation constant and slot spacings are the same as those discussed for the two auxiliary line embodiment 11. As is well known in the art, the slot length and width are basically influenced by the slot coupling desired in order to minimize losses and efficiently couple to the $TE_{21}$ mode.

The combining circuitry required for this configuration is shown in FIG. 8. Here, the circuitry consists of two 1:2 combiners (magic tees 151 and 153) that are provided with appropriate loads 155 and 157, respectively, and a conventional quadrature hybrid combiner 159.

Figure 9A:
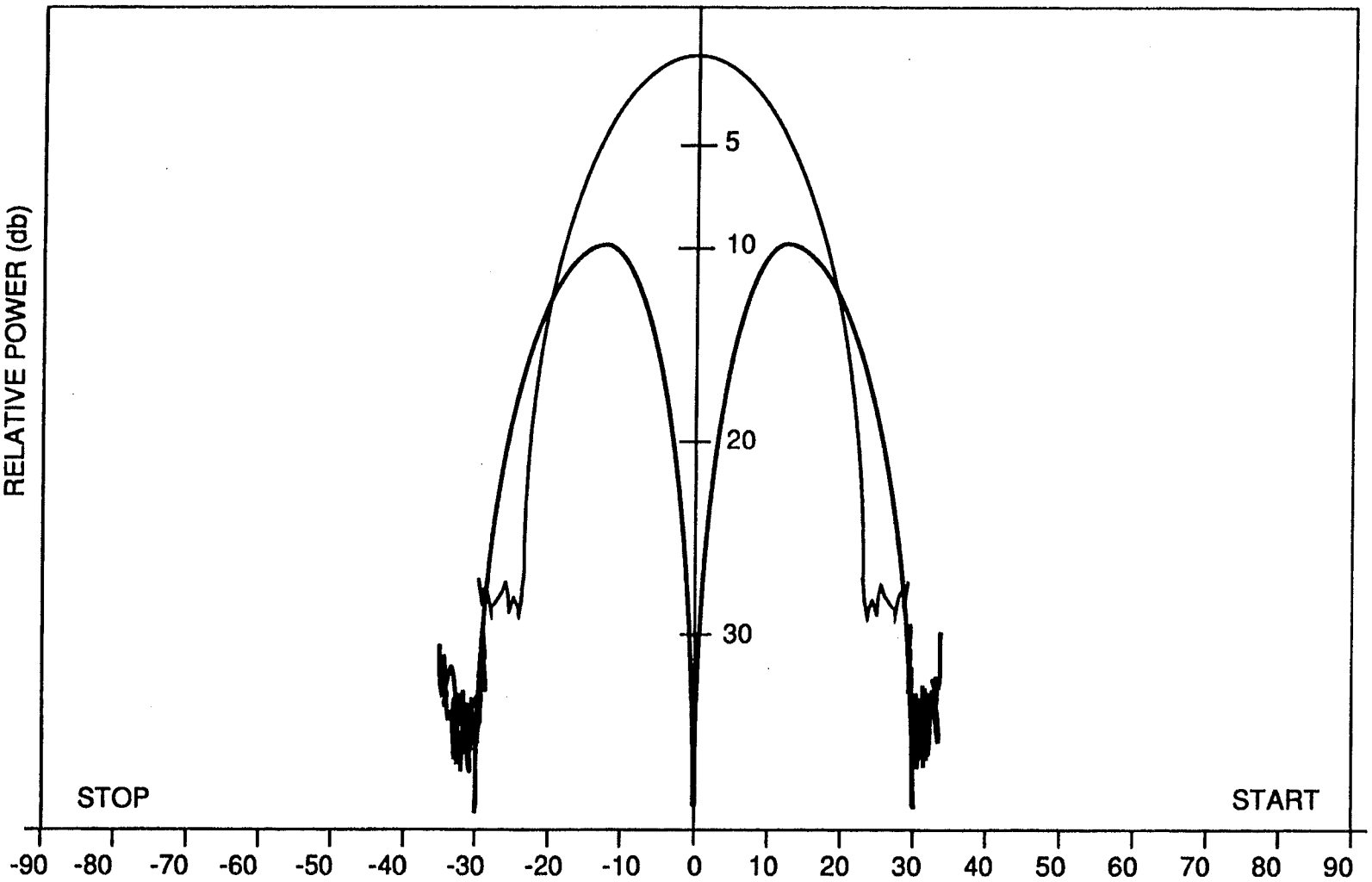
FIG. 9A is a graph showing the H-plane difference patterns produced by a single auxiliary line coupled to the main line circular waveguides of FIG. 1 taken orthogonal to the auxiliary waveguide.
Figure 10A:
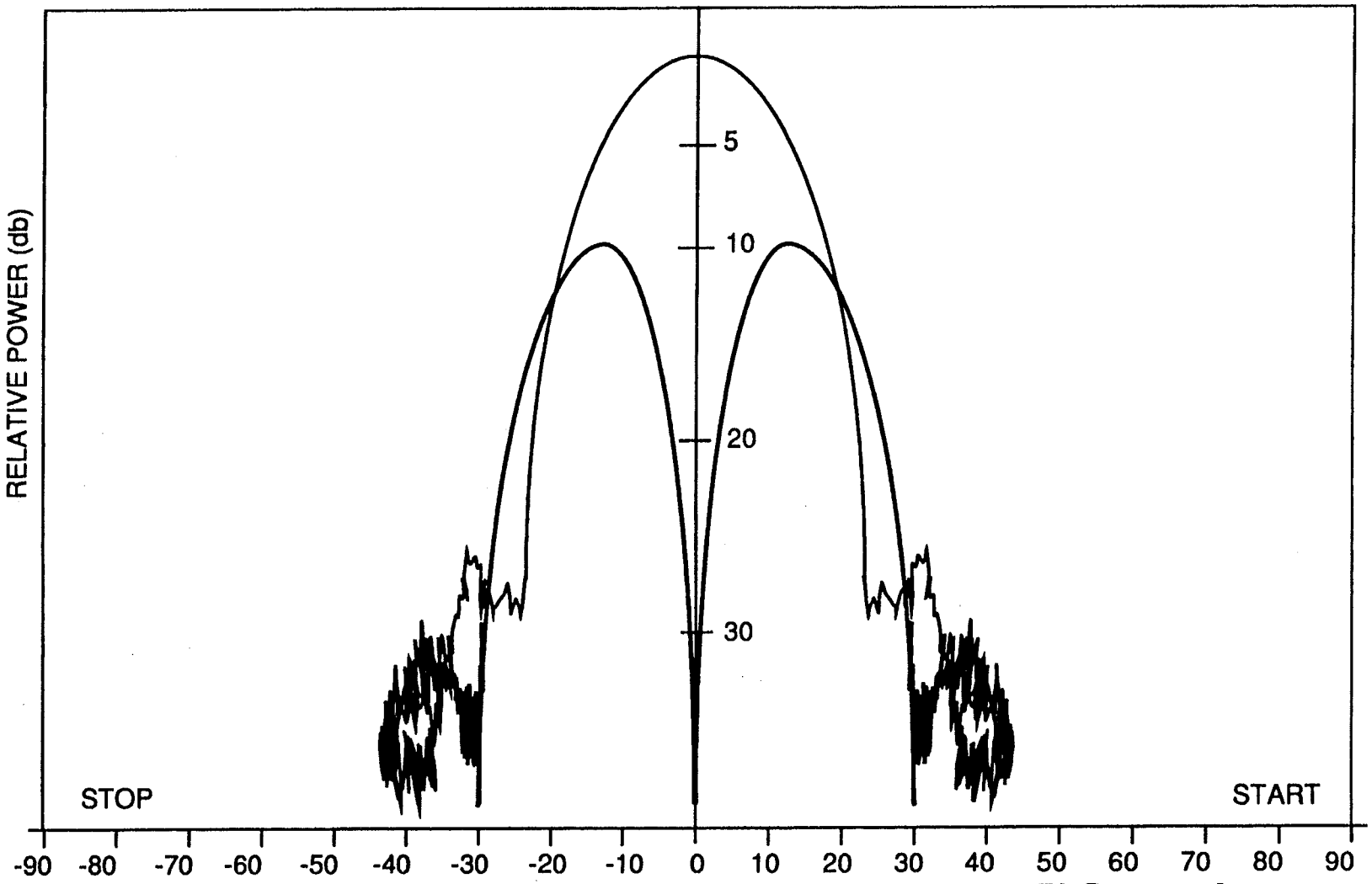
FIG. 10A is a graph showing the H-plane difference patterns produced by a single auxiliary line coupled to the main line circular waveguides of FIG. 1 taken paralle to the auxiliary waveguide.
Figure 10B:
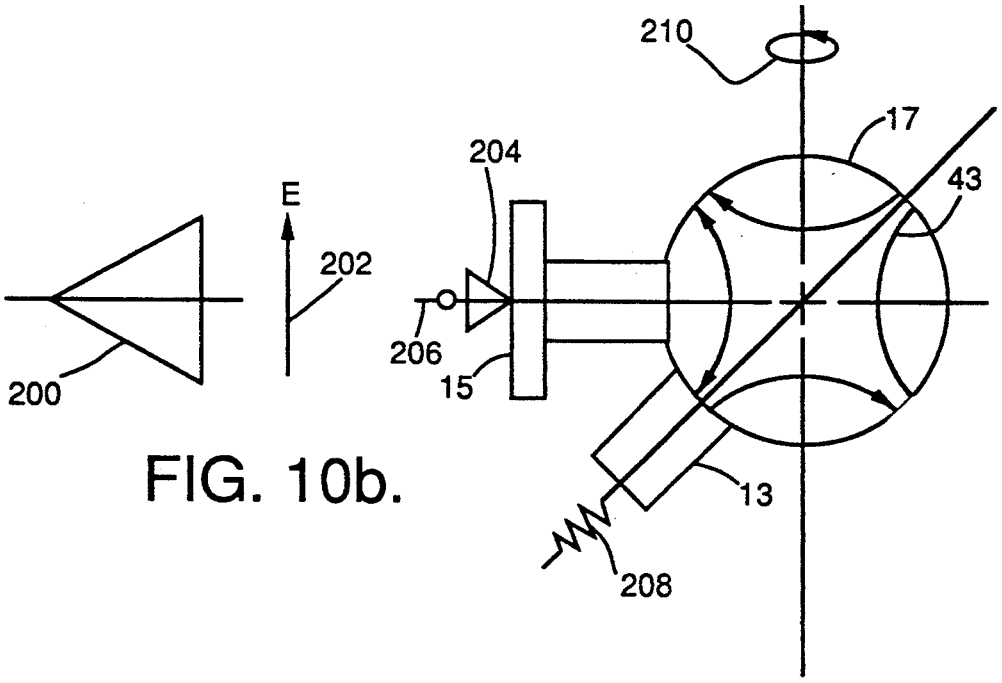
FIG. 10B illustrates the test setup for measuring the $TE_{21}$ H-plane pattern parallel to the auxiliary waveguide.

Prototypes of the dual and four auxiliary line couplers described above have been tested in an RF anechoic chamber to demonstrate the coupling performance of the $TE_{21}$ mode. The prototype couplers were designed for the 19.3 to 19.75 GHz frequency band. A diameter of 0.660 inches was selected for the circular waveguide which supports propagation of the $TE_{21}$ mode and has a cutoff frequency of 21.8 GHz for the $TE_{01}$ and $TM_{11}$ circular waveguide modes. Thus the $TE_{01}$, $TM_{11}$ and other higher order modes will not be supported by the diameter selected for the circular waveguide. These couplers were tested with a corrugated horn and radiation patterns were obtained and examined for the purity of the $TE_{21}$ mode. Both cases demonstrated $TE_{21}$ mode excitation with no coupling between the $TE_{21}$ and $TE_{11}$ modes or excitation of other circular waveguide modes. Example patterns demonstrating the difference patterns produced by a single auxiliary line coupled to the main line circular waveguide are shown in FIGS. 9A and 10A. These are H-plane patterns taken orthogonal and parallel to the axes of the auxiliary waveguide 15, respectively. These patterns were measured as illustrated in FIGS. 9B and 10B, respectively, using transmit source 200 having polarization 202, a detector 204 located on the axis 206 of waveguide 15, and with auxiliary waveguide 13 terminated at 208. Reference numeral 210 indicates the rotation axis.

Thus there has been described new and improved asymmetrically coupled $TE_{21}$ couplers. It is to be understood that the above-described embodiments are merely illustrative of some of the many specific embodiments which represent applications of the principles of the present invention. Clearly, numerous and other arrangements can be readily devised by those skilled in the art without departing from the scope of the invention.

What is claimed is:

1. An asymmetrically coupled $TE_{21}$ coupler, comprising:

$TE_{21}$ circular waveguide means dimensioned to support no higher order circular waveguide modes and having a center line therethrough, and for supporting orthogonally aligned $TE_{21}$ modes therein;

auxiliary waveguide means including at least one pair and no more than two pairs of auxiliary rectangular waveguides supporting $TE_{10}$ modes, each of the rectangular waveguides of said one or two pairs being asymmetrically disposed around said circular waveguide means relative to said center line, said circular and rectangular waveguides sharing respective common walls;

coupling means disposed in said common walls for providing rectangular $TE_{10}$ mode propagation coupling to said orthogonally aligned $TE_{21}$ modes; and combining circuitry coupled to said auxiliary waveguide means for combining signals at said auxiliary rectangular waveguides.

2. The asymmetrically coupled $TE_{21}$ coupler according to claim 1, wherein the rectangular waveguide $TE_{10}$ mode propagation constant is equal to the $TE_{21}$ circular waveguide mode propagation constant.

3. The asymmetrically coupled $TE_{21}$ coupler according to claim 1, wherein said auxiliary waveguide means consists of one pair of auxiliary rectangular waveguides, and wherein said combining circuitry comprises quadrature hybrid means coupled to said pair of rectangular waveguides for combining said signals at said pair of auxiliary waveguides with a 90° time phase offset.

4. The asymmetrically coupled $TE_{21}$ coupler according to claim 1, wherein said auxiliary waveguide means includes two pairs of oppositely disposed auxiliary waveguides, each pair being disposed asymmetrically around said circular waveguide means relative to said center line.

5. The asymmetrically coupled $TE_{21}$ coupler according to claim 1, wherein said coupling means includes coupling slots disposed in said common walls and spaced at $\frac{1}{4}$ the waveguide wavelength for said $TE_{21}$ circular waveguide mode.

6. The asymmetrically coupled $TE_{21}$ coupler according to claim 1, wherein said coupling means includes coupling slots disposed in said common walls and spaced at $\frac{1}{4}$ the waveguide wavelength for said $TE_{10}$ rectangular waveguide mode.

7. The asymmetrically coupled $TE_{21}$ coupler according to claim 4, wherein said combining circuitry comprises quadrature hybrid combiner and a 1:2 combiner coupled to each said pair of auxiliary waveguides, the output of each of said 1:2 combiners being coupled to separate inputs of said quardrature hybrid combiner.

8. An asymmetrically coupled $TE_{21}$ coupler, comprising:

$TE_{21}$ circular waveguide means dimensioned to support no higher order circular waveguide modes and having a center line therethrough, and for supporting orthogonally aligned $TE_{21}$ modes therein;

auxiliary waveguide means including at least two auxiliary rectangular waveguides supporting $TE_{10}$ modes, asymmetrically disposed around said circular waveguide means relative to said center line, said circular and rectangular waveguides sharing respective common walls;

coupling means disposed in said common walls for providing rectangular $TE_{10}$ mode propagation coupling to said orthogonally aligned $TE_{21}$ modes; and quadrature hybrid means coupled to said rectangular waveguides for combining said two equal orthogonally aligned $TE_{21}$ modes with a 90° time phase offset.

9. An asymmetrically coupled $TE_{21}$ coupler, comprising:

$TE_{21}$ circular waveguide means dimensioned to support no higher order circular waveguide modes and having a center line therethrough, and for supporting orthogonally aligned $TE_{21}$ modes therein;

auxiliary waveguide means including at least two auxiliary rectangular waveguides supporting $TE_{10}$ modes, asymmetrically disposed around said circular waveguide means relative to said center line, said circular and rectangular waveguides sharing respective common walls, said auxiliary waveguide means including two pairs of oppositely disposed auxiliary waveguides, each pair being disposed asymmetrically around said circular waveguide means relative to said center line;

coupling means disposed in said common walls for providing rectangular $TE_{10}$ mode propagation coupling to said orthogonally aligned $TE_{21}$ modes; and quadrature hybrid combiner and combining circuitry means including a 1:2 combiner coupled to each said pari of auxiliary waveguides, the output of each of said 1:2 combiners being coupled to separate inputs of said quardrature hybrid combiner.

* * * * *